US006017063A

United States Patent [19]

Nilssen

[11] Patent Number: 6,017,063

[45] Date of Patent: Jan. 25, 2000

[54] FINANCIAL CERTIFICATES, SYSTEM AND PROCESS

[76] Inventor: Ole K. Nilssen, Caesar Dr., Barrington, Ill. 60010

[21] Appl. No.: 07/919,242

[22] Filed: Jul. 23, 1992

Related U.S. Application Data

[63] Continuation-in-part of application No. 07/312,455, Feb. 21, 1989, abandoned, which is a continuation-in-part of application No. 07/118,000, Nov. 9, 1987, abandoned.

[51] Int. Cl.[7] ..... B42D 15/00

[52] U.S. Cl. ..... 283/67; 283/57; 235/379

[58] Field of Search ..... 283/44, 45, 57, 283/58, 59, 60.1, 67, 70; 235/375, 379, 380, 381

[56] References Cited

U.S. PATENT DOCUMENTS 5,178,417 1/1993 Eshoo ..... 283/117

5,193,855 3/1993 Shamos ..... 283/117

*Primary Examiner*—Willmon Fridie, Jr.

[57] ABSTRACT

A financial and/or a commercial enterprise, such as a mutual funds operator and/or a general merchandise/product sales establishment, prices its various financial and/or commercial goods in certain basic pricing units and sells uniquely coded certificates denominated in such pricing units; which pricing units are of such nature as to be substantially unaffected by inflation. Then, at any later time the holder of such a certificate is entitled to exchange this certificate for financial and/or commercial goods equivalent in total pricing units to the denomination specified on the certificate, regardless of any intervening changes in dollar pricing of the various items of financial and/or commercial goods. Since the purchaser of a certificate helps pay for the inventory of financial and/or commercial goods underlying the certificates, each holder of such a certificate periodically receives an interest payment in the form of a pre-established probabilistic chance to win additional certificates.

10 Claims, 2 Drawing Sheets

FINANCIAL CERTIFICATES, SYSTEM AND PROCESS

Related Applications

This application is a Continuation-in-Part of Ser. No. 07/312,455 filed Feb. 21, 1989, now abandoned; which is a Continuation-in-Part of Ser. No. 07/118,000 filed Nov. 09 1987, now abandoned.

BACKGROUND OF THE INVENTION

1. Field of the Invention

The present invention relates to financial instruments, systems and processes.

2. Description of Prior and/or Related Art

Various financial instruments, systems and processes are described in the following U.S. Pat. Nos.: 4,997,188; 5,082,275; 5,083,782; and 5,083,784; all of which patents are issued to Nilssen.

SUMMARY OF THE INVENTION

Objects of the Invention

A general object of the present invention is the provision of a system and process for issuing and processing financial certificates representing real financial/economic value to the holders of such certificates.

This as well as other objects, features and advantages of the present invention will become apparent from the following description and claims.

Brief Description

A financial and/or a commercial enterprise, such as a mutual funds operator and/or a general merchandise/product sales establishment, prices its various financial and/or commercial goods in certain basic pricing units and sells uniquely coded certificates denominated in such pricing units; which pricing units are of such nature as to be substantially unaffected by inflation. Then, at any later time the holder of such a certificate is entitled to exchange this certificate for financial and/or commercial goods equivalent in total pricing units to the denomination specified on the certificate, regardless of any intervening changes in dollar pricing of the various items of financial and/or commercial goods. Since the purchaser of a certificate helps pay for the inventory of financial and/or commercial goods underlying or backing the certificates, each holder of such a certificate periodically receives an interest payment in the form of a pre-established probabilistic chance to win additional certificates.

More particularly, subject financial certificates, system and process are represented by the following key steps and component parts:

(1) a first entity operative, in return for money received, to issue to each of various individual entities (ex: persons) a number of uniquely coded certificates;

(2) a second entity functionally connected with the first entity and operative to utilize the money received by the first entity for acquiring various financial instruments, items of merchandise, and/or other goods having financial value (hereinafter collectively referred-to as "financial/commercial goods");

(3) a third entity functionally connected with the first and second entities and operative: (i) to issue financial/commercial goods in return for certificates; and (ii) to convey the certificates received to the first entity; and (4) a fourth entity functionally connected with the second and third entities and operative to provide information to the third entity with respect to the appropriate amount of financial/commercial goods to issue in exchange for each pricing unit.

DESCRIPTION OF THE PREFERRED EMBODIMENTS

Details of Construction of Initially Preferred Embodiment

Figure 1:
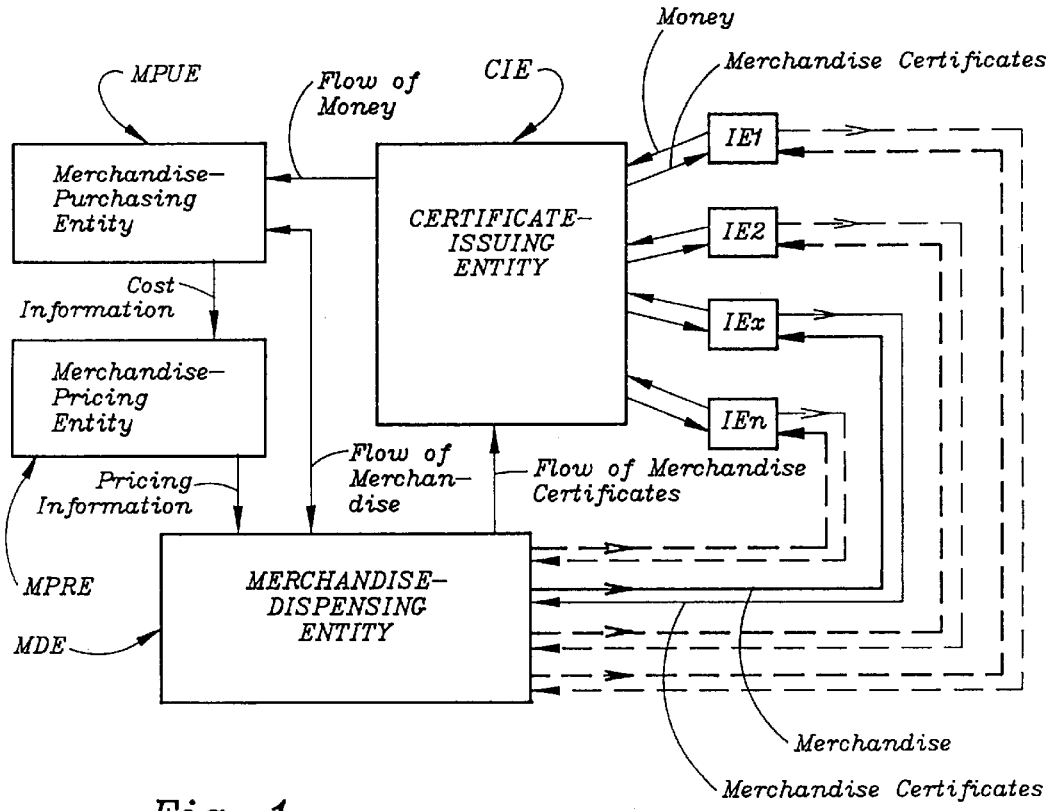
FIG. 1 diagrammatically illustrates an initially preferred embodiment of the invention.

FIG. 1 is a combination systems-process diagram that illustrates the system operative to effectuate the process of the initially preferred version of the present invention.

In FIG. 1, numerous individual entities are identified as IE1, IE2 . . . IEx . . . IEn; each of which numerous individual entities—at one time or another—is operationally connected with a certificate-issuing entity CIE as well as with a merchandise-dispensing entity MDE. Certificate-issuing entity CIE is operationally connected with an investment- and merchandise-purchasing entity MPUE as well as with dividend-and merchandise-dispensing entity MDE. Merchandise-purchasing entity MPUE is operationally connected with a merchandise-pricing entity MPRE as well as with merchandise-dispensing entity MDE. Merchandise-pricing entity MPRE is operationally connected with merchandise-dispensing entity MDE.

Details of Operation of Initially Preferred Embodiment

Numerous individual entities (IE1/IE2/IEx/IEn) will, at one time or another, interact with CIE in such manner as to convey to it one or more units of monetary value (ex: dollars) in exchange for one or more uniquely coded merchandise certificates. Each such uniquely coded merchandise certificate is identified in a manner that reflects the fact that it represents a certain amount of merchandise—or a certain number of merchandise units; which amount of merchandise will be delivered to the bearer of the certificate in exchange therefor.

CIE keeps account of all the uniquely coded merchandise certificates issued (or sold) by it to the various individual entities; and transmits to MDE information with respect to key characteristics of these certificates, such as identification codes and denominations in merchandise units.

CIE conveys to MPUE the money it receives in exchange for merchandise certificates. In response to information received from MDE, MPUE uses the money received from CIE to purchase merchandise and/or income-producing means from various sources; which merchandise, when received, it routed to MDE.

Depending on the amount of merchandise needed by MDE, MPUE may use more or less of the money received from CIE to purchase merchandise. To the extent that MPUE accumulates more money than that required to purchase the merchandise needed by MDE, MPUE will buy income-producing means: government bonds, corporate capital stock, etc.

Periodically and repeatedly, such as once each week, MDE will randomly select the identification code of one of the issued merchandise certificates and accredit the certificate bearing the chosen identification code with an extra amount of merchandise.

Thereafter, MDE arranges to inform the holders of the issued merchandise certificates with respect to particulars of the chosen identification code and the amount of additional merchandise units accredited to the holder of the certificate bearing that code. The holder of the merchandise certificate bearing that code is entitled, in exchange therefor, to obtain from MDE a new merchandise certificate valid for the amount of merchandise units of the old certificate in addition to the amount of merchandise units now additionally accredited thereto.

The process of randomly choosing one or a few identification codes and making a substantial disbursement of merchandise units to each of the holders of the merchandise certificates bearing the chosen codes is carried out on a substantially continuous basis; which means that each individual merchandise certificate represents a continuously repeating opportunity to receive a substantial disbursement of additional merchandise units.

Thus, in addition to being guaranteed not to lose value due to inflation of ordinary dollar currency, each merchandise certificate represents a true investment that—on a statistical basis—will yield a real and significant return. Moreover, it repeatedly provides a degree of lottery-like excitement.

A merchandise certificate would only be redeemable in merchandise, and only in the amount of merchandise represented by the number of merchandise units identified on the certificate. However, means are provided whereby the certificate-issuing entity (CIE) will exchange a merchandise certificate for an appropriate sum of ordinary monetary currency; which appropriate sum would be determined by prevailing market forces.

MPE is responsible for pricing each item of MDE's merchandise in terms of merchandise units. The value of one merchandise unit is established on the basis of a clearly defined "basket" of merchandise—much in the same way as the Goverment's Consumer Price Index is established.

In fact, at least initially, the Consumer Price Index will be used as the main determinant of the exchange rate between merchandise units and dollars: one merchandise unit will be priced in cents equal to the currently prevailing Consumer Price Index (ex: 119.8 as of September 1988). Thus, as of September 1988, the price of one merchandise unit would have been $1.20 or thereabouts.

The merchandising dispensing entity could in reality be a number of different merchandising entities, each at a different location and/or with a different collection of merchandise.

The merchandise offered by MDE may include a wide variety of things and services: essentially anything that may be purchased by ordinary dollar currency—items such as general merchandise, automobiles, gasoline, air planes, coal, industrial supplies & raw materials, commodities, stocks & bonds, contracts, mortgages, real estate, etc.

Additional Comments re Initially Preferred Embodiment (a) To a person of ordinary skill in the arts most nearly relevant hereto, it will be clear that all the functions associated with the various functional blocks of the systems-process block diagram of FIG. 1 may be performed by automatic means, such as by way of pre-programmed computer and dispenser means. For instance, an automatic teller machine may accept dollar payments from an individual entity or person and issue to him merchandise certificates in exchange therefor—each merchandise certificate having a unique identification code.

Alternatively, some or all of the various functions may be accomplished by persons of ordinary skills by simply following clearly specifiable procedures.

(b) After a very large number of merchandise certificates have been issued, to provide for an increased level of perceived value (such as by providing for a significant degree of lottery-like excitement) , one of the periodically chosen identification codes would be accredited with a particularly high pay-out, such as the equivalent of several million dollars. This increased pay-out would be counterbalanced by somewhat reduced pay-outs to the other chosen identification codes.

(c) It is anticipated that the merchandise certificates will be of at least two different types. One type would permit the individual owner to be specifically identified; another type would be in the form of bearer certificates requiring special coded identification for redemption by the bearer.

(d) In case the holder of a merchandise certificate with a chosen identification code chooses not to or otherwise fails to collect the premium accredited to that chosen identification code, the probability of that particular identification code being chosen in the future will be adjusted upward by a factor equal to the factor by which the amount of uncollected premium exceeds the value of the merchandise certificate with the chosen identification code.

More particularly, by way of example, if a given merchandise certificate be valued at the equivalent of $10, and if at one point in time that cercificate were chosen to be accredited with a premium equivalent to $2000, then—for as long as the accredited premium were to remain uncollected—this particular certificate would partake in future random choosings with a probability of being chosen that be 201 times higher than it was before.

(e) The term Merchandise Units may more illustratively be called Pricing Units.

(f) Some of the indicated functions, such as investment of funds in excess of what is needed to purchase merchandise, may be accomplished by any one of the indicated entities; or, it may be accomplished by a separate entity.

(g) After a substantial number of merchandise certificates have been issued, it is anticipated that a secondary market for such merchandise certificates will come about: they will be sold and bought at a price established by market forces. Thus, as continuous devaluation of the dollar takes place—as it does as a result of inflation—the dollar-value of a merchandise certificate will gradually increase: about enough to off-set inflation.

(h) It is anticipated that subject merchandise certificates and system be established and operated in such manner as to permit the participation therein of a large number and a wide variety of individual business enterprises, with at least some of these performing the functions of selling merchandise certificates, purchasing merchandise, and dispensing merchandise in exchange for such certificates. However, the function of the merchandise pricing entity (the keeper/accountant/auditor of the merchandise "basket") would anticipatedly be accomplished by a central means.

(i) Although each and every one of the various functions associated with the system of FIG. 1 may be accomplished by fully automatic means, it is anticipated that—especially in the initial phases of implementation—some of the functions will be accomplished by humans following simple explicit instructions with the help of simple electronic and/or electro-mechanical aids (e.g., calculators, computers, data terminals, cash registers, communication links, copy & fax machines, etc.).

For instance:

(1) the Certificate-Issuing Entity (CIE) will use humans to perform the function of exchanging Merchandise Certificates for Money or Money-Equivalents;

(2) the Merchandise-Dispensing Entity (MDE) will use humans to perform the function of exchanging specific items of merchandise for Merchandise Certificates (which items of merchandise will all be plainly priced in Merchandise Units);

(3) the Merchandise-Purchasing Entity (MPUE) will use humans for buying merchandise in accordance with specific instructions to the effect of using the money received from the Certificate Issuing Entity to buy and maintain an inventory of merchandise directly corresponding (in terms of individual items and quantities thereof) to the items of merchandise contained in the basket of goods and services used by the U.S. Department of Labor in determining the Consumer Price Index; and (4) the Merchandise-Pricing Entity (MPRE) will use humans to maintain a current price (denominated in Merchandise Units) to be charged for each individual item of merchandise; which current price will directly correspond to the current dollar market price for such individual item of merchandise except for having been converted from dollars to Merchandise Units; which conversion will—for each particular item of merchandise—be determined by multiplying the current dollar market price of this particular item of merchandise by 100 and by dividing the result with the current Consumer Price Index. (Thus, with the Consumer Price Index being 140.2 on Jul. 17, 1992, an individual item of merchandise having a dollar market price of $200.00 on Jul. 17, 1992, will have a price of 200.00 divided by 1.402 or 142.65 Merchandise Units. In other words, on Jul. 17, 1992, one dollar is equivalent to 0.71 Merchandise Unit; which is to say that—on Jul. 17, 1992—one dollar will get you 0.71 Merchandise Unit. On the other hand, on Jul. 17, 1972, one dollar would have gotten you 3.36 Merchandise Units.) .)

(j) To a person having ordinary skill in the art pertinent hereto, it will be perfectly clear that each of the functions required to be performed by the various functional blocks of FIG. 1 can be performed by automatic means. For instance:

(1) the Certificate-Issuing Entity can be a dedicated but otherwise ordinary computer/dispenser means (hereinafter "Issuing Computer") similar to those widely used by banks to dispense cash in response to the insertion of a credit card and a personal code number, except that this particular terminal would dispense Merchandise Certificates in place of dollar bills; which Issuing Computer would be in communication with an account in a bank, which account would be dedicated to the Merchandise-Purchasing Entity (hereinafter "Purchasing Account") and would be credited with the dollar funds having been received by the Certificate-Issuing Entity in exchange for Merchandise Certificates;

(2) the Merchandise-Dispensing Entity can be a dedicated but otherwise ordinary computer means (hereinafter "Dispensing Computer") combined with a robot means made in accordance with well known prior art (hereinafter "Robot") and functioning in a warehouse filled with items of merchandise having been purchased by the Merchandise-Purchasing Entity, with each item of merchandise having been moved into and stored in a pre-designated location in the warehouse by the Robot acting on instructions from the Dispensing Computer; from which pre-designated location, in response to further instructions from the Dispensing Computer, a selected item of merchandise would be removed by the Robot and dispensed to an Individual Entity; which individual Entity had previously deposited in a special receptacle means combined with the Dispensing Computer a sufficient number of Merchandise Certificates to cover the price of the selected item of merchandise; which selected item of merchandise the Individual Entity had previously identified by keying-in appropriate descriptive information on a keyboard connected with the Dispensing Computer;

(3) the Merchandise-Purchasing Entity can also be a dedicated but otherwise ordinary computer means (hereinafter "Purchasing Computer") connected in communication with the Purchasing Account as well as with the U.S. Department of Labor, Bureau of Labor Statistics ("Bureau"); which Purchasing Computer would be arranged to be periodically updated with certain data generated and published by the Bureau; which certain data would include, in addition to the most recent numerical value for the Bureau's Consumer Price Index ("CPI"), the most recent dollar market price found by the Bureau to prevail with respect to each and every item of merchandise included in the basket of goods and services underlying the CPI; the Purchasing Computer would also be in communication with: (i) the Dispensing Computer and would receive therefrom information regarding what specific items of Merchandise had been dispensed in exchange for Merchandise Certificates; and (ii) most importantly, various sources of merchandise (e.g., warehouses, manufacturers, etc.) to which it would automatically (a) issue purchase orders for the specific items of merchandise needed to make its current inventory of merchandise correspond, both in kind and proportion, to the items of merchandise included in the basket of goods and services underlying the CPI, and (b) pay for these items by transferring funds from the Purchasing Account to the bank accounts of the various sources of merchandise; and (4) just as with the Merchandise-Purchasing Entity, the Merchandise-Pricing Entity can also be a dedicated both otherwise ordinary computer (hereinafter "Pricing Computer") connected with the Bureau and arranged to be periodically updated with certain data generated and published by the Bureau; which certain data would include, in addition to the most recent numerical value for the CPI, the most recent dollar market price found by the Bureau to prevail with respect to each and every item of merchandise included in the basket of goods and services underlying the CPI; which Pricing Computer would also be in communication with: (i) the Issuing Computer, providing thereto the most current information with respect to how much should be charged for each Merchandise Certificate; and (ii) the Dispensing Computer, providing thereto the most current information with respect to how many Merchandise Units should be charged by the Merchandise-Dispensing Entity for each specific item of of merchandise.

(k) To provide further details regarding the construction, inter-connections and functions of the various dedicated computer means, dispenser means, and robot means referred-to in section (j) hereinabove is believed to be counter-productive in the sense of detracting from the efficient absorbtion/understanding of instant invention; which invention has nothing to do with such further details.

On the other hand, if a person were to be interested in constructing and operating a merchandise certificate system such as that schematically illustrated by FIG. 1, and if that person were to need further information in regard to how to construct and/or implement the system in accordance with the arrangement described in section (i) hereinabove, he is directed to any one of numerous well known computer, automation, automatic vending and/or robot & robotic systems companies for whatever particular detailed information he might need.

In particular and by way of example, some such companies would be:

Control Data Corp., Minneapolis, Minn.;

Digital Equipment Corporation, Maynard, Md.;

IBM Corporation, Armonk, N.Y.;

Unisys Corporation, Blue Bell, Pa.;

Computer Sciences Corporation, El Segundo, Calif.;

EDS, subsidiary or General Motors Corp. Detroit, Mich.;

SHL Systemhouse Inc., Ottawa, Canada;

Details Regarding Presently Preferred Embodiment

Figure 2:
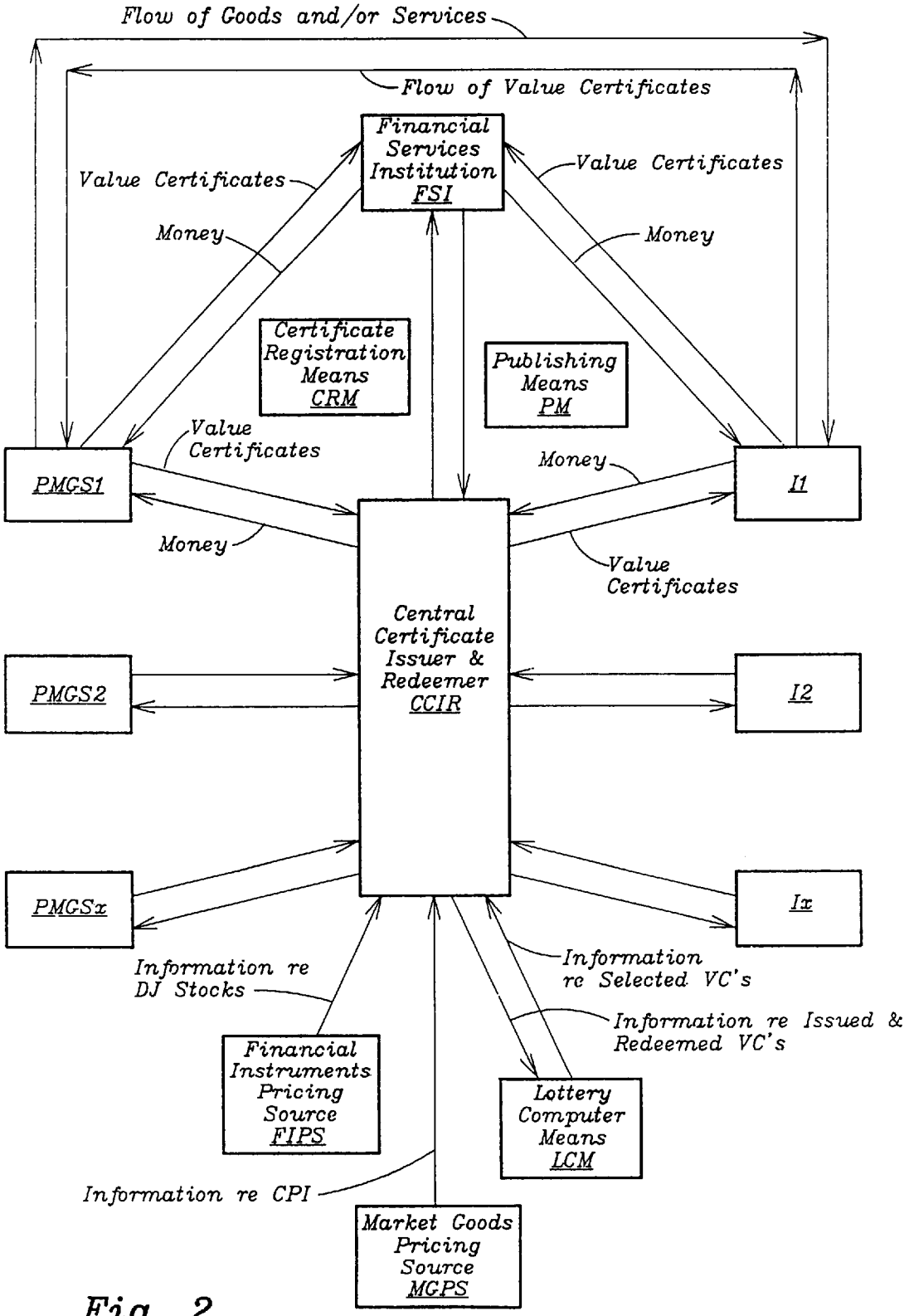
FIG. 2 diagrammatically illustrates the presently preferred embodiment of the invention.

FIG. 2 is a combination systems-process diagram that illustrates the system operative to effectuate the process of the presently preferred version of instant invention.

In FIG. 2, a Central Certificate Issuer and Redeemer CCIR is connected with a Market Goods Pricing Source MGPS, a Lottery Computer Means LCM, a Financial Instruments Pricing Source FIPS, a Financial Services Institution FSI, a Publishing Means PM, a Certificate Registration Means CRM, as well as plural Purveyors of Market Goods and/or Services PMGS1, PMGS1 . . . PMGSx. Also connected with the Central Certificate Issuer and Redeemer are plural Individuals I1, I2 . . . Ix; which Individuals are also in optional connection with the Purveyors of Market Goods and/or Services.

Of course, Central Certificate Issuer and Redeemer CCIR would comprise various computer and communications means; which computer and communication means would be programmed and/or designed such as to perform the particular functions identified hereinbelow as having to be performed by this Central Certificate Issuer and Redeemer. However, since it would be well known by persons having ordinary skill in the pertinent art how to program and/or design such computer and communications means, and since details with respect to the programming and/or design of such computer and communication means form no part of instant invention, such programming and/or design details will not be explicitly described herein. However, they will be implicitly described by virtue of specifying their functional features.

In further detail, the system of FIG. 2 may be described as follows.

Market Goods and Services Pricing Source MGSPS may be any one of several different types of services keeping track of market prices of different types of goods and services available on the market. For instance, the Bureau of Labor Statistics of the U.S. Department of Labor (the "Bureau"), in order to generate its Consumer Price Index (the "CPI"), continuously gathers information with respect to current market prices of a wide variety of goods and services representive of a pre-defined selection of goods and services (the "Basket"); which information is available to the public. In the presently preferred embodiment of instant invention, the Bureau is indeed used as Market Goods Pricing Source MGPS. More particularly, as published by the Bureau, the most recent numerical values for the CPI (which, as of Jul. 17, 1992, happens to be 140.2) are communicated to Central Certificate Issuer and Redeemer CCIR.

Financial Instrument Pricing Source FIPS may be any one of several different types of services keeping track of market prices of different types of financial instruments or securities, such as stocks, bonds, futures, etc. For instance, Dow Jones & Company of New York, N.Y., ("Dow Jones") provides services by which a subscriber receives current market prices of individual and/or particular groups of financial securities. More particularly, in the presently preferred embodiment, Central Certificate Issuer and Redeemer CCIR uses Dow Jones as Financial Instrument Pricing Source and is connected with Dow Jones such to receive current information with respect to the numerical value of the so-called Dow Jones Industrial Average.

Financial Services Institution FSI may be any one of several different types of financial services institutions capable of performing various conventional financial services, such as: checking, wire-transfer of funds; buying, holding, selling financial securities; etc. As an example, Financial Services Institution FSI may be an ordinary bank (such as The Chase Manhattan Bank of New York, N.Y.); which bank would be connected with Central Certificate Issuer and Redeemer CCIR via electronic communication means by which CCIR issues explicit orders with respect to what financial transactions should be effected by the bank on behalf of CCIR.

Each of the plural Purveyors of Market Goods and Services (hereinafter sometimes referred to as "PMGS" or "Purveyors") have available various goods and/or services, some or all of which (in exchange for elements of appropriate value, such as an appropriate amount of U.S. dollars) may be obtained by any one of plural Individuals I1, I2 . . . Ix. Thus, in effect, the Purveyors possess inventories of goods and/or services; which goods and/or services may encompass substantially anything having value and capable of being sold.

On basis of information received from Market Goods and Services Pricing Source MGSPS, Central Certificate Issuer and Redeemer CCIR issues Value Certificates (hereinafter sometimes merely referred-to as "VC" or "VC's"), with each such VC being denominated in some specified number of (e.g., 100) Value Units (hereinafter sometimes referred-to as "VU" or "VU's"). In terms of effective purchasing power, one VU has a value equal to that of one U.S. dollar at a given point in time. More particularly, in the presently preferred embodiment, the effective purchasing power of one VU equals that of one U.S. dollar multiplied by 100 and divided by the numerical value of the most current CPI. Thus, as of Jul. 17, 1992—with the CPI standing at 140.2 the effective purchasing power of 100 VU's is equal to that of $140.20.

In other words, the value of one VU is equal to that of one U.S. dollar multiplied by an Inflation Factor; which Inflation Factor—at any given time—is equal to the numerical value of the CPI at that given time divided by 100; which means that, as of Jul. 17, 1992, the Inflation Factor was 1.402.

Value Certificates may be used by Individuals I1, I2 . . . Ix for purchasing items of goods and/or services from the plural Purveyors of Market Goods and Services. More particularly, the amount of goods and/or services obtainable from the Purveyors on basis of a given number of VU's is equal to the amount of goods and services that may be purchased by an amount of U.S. dollars larger (or smaller) than this given number by the Inflation Factor.

VC's received by the Purveyors in exchange for goods and/or services are transferred to Central Certificate Issuer and Redeemer CCIR; which will redeem such VC's in U.S. dollars of matching purchasing power, less a pre-stipulated service charge.

Thus, an individual may purchase VC's from Central Certificate Issuer and Redeemer CCIR, paying therefor an amount of U.S. dollar corresponding to the purchasing power of those VC's at the time of purchase. Then, at some later time—perhaps 50 years later—this individual (or some person to whom this individual had given his VC's) may use these VC's to purchase some goods and/or services from one or more of the Purveyors. That is, he redeems his VC's for the goods and/or services which they represented in the first place.

Each individual VC is a uniquely coded bearer-type certificate; which is to say: whomever has legal possession of such a VC may present it to the Purveyors in exchange for his choice—withing the limit of its purchasing power—of available goods and/or services.

To endow the VC's with additional value, arrangements are provided by which, periodically, the code-number of one of the issued VC's is randomly selected and accredited with a relatively large amount of added purchasing value. This random selection is effectuated by Lottery Computer Means LCM; which preferably is a nationally reputable CPA company (such as Arthur Andersen and Company of Chicago, Ill.) capable of credibly performing a periodic lottery-like selection of one particular VC from from among the total number of VC's having been issued by Central Certificate Issuer and Redeemer CCIR to the plural Individuals I1, I2 . . . Ix. In particular, Lottery Computer Means LCM is arranged: (i) to receive information from Central Certificate Issuer and Redeemer CCIR with respect to the unique code number of each and every as-yet-unredeemed VC having been issued by the CCIR; (ii) periodically to make a choice of one (or a few) of those code numbers; and (iii) to inform Central Certificate Issuer and Redeemer CCIR of the choices made. In turn, the CCIR communicates the chosen code numbers to Publishing Means PM; which then arranges for having the chosen code numbers published and/or otherwise communicated to the holders of VC's.

Additional Comments re Presently Preferred Embodiment (aa) If desired, a person may have one or more VC's issued in his or someone's particular name; in which case those particular VC's are registered—in terms of their particular code numbers and the name of the person to whom they are registered—by Certificate Registration Means CRM.

(ab) In the preferred embodiment, the Central Certificate Issuer and Redeemer is a combination computer-robot-communication means; which computer-robot-communication means is designed and programmed to effectuate the particular process described hereinabove in connection with the arrangement of FIG. 2. In any case, no person (i.e., no human mind, no human judgment) is used or is needed in performing any of the steps in the process effectuated by way of the arrangement or system illustrated by FIG. 2.

(ac) In particular and by way of examples, in the system of FIG. 2:

(1) Central Certificate Issuer and Redeemer CCIR comprises an Automatic Certificate Vending Machine ("ACVM") via which a person (hereinafter referred-to as "Person") may purchase any number of VC's by inserting a credit card (or other type of bank card) in conjunction with keying-in a (secret) personal identification number—in a manner identical to that used when obtaining cash from a bank's Automatic Teller Machine. After having debited the Person's individual's credit card account with the amount required for obtaining the desired number of VC's, this amount is credited to CCIR's account in its associated Financial Services Institution FSI (hereinafter sometimes referred-to as the "FSI" and the "FSI Account", as appropriate), after which the ACVM dispenses the purchased CV's to the Person.

(2) The FSI invests a substantial part of the funds in the FSI Account in financial securities, such as stocks and/or bonds. More particularly, in the preferred embodiment, the FSI invests those funds approximately as follows: (i) one third of the funds are invested in so-called money market accounts; and (ii) two thirds of the funds are invested in shares of the capital stock of the particular industrial companies whose shares of capital stock make up the so-called Dow Jones Industrial Average (hereinafter referred-to as "DJ Stocks"), buying such DJ Stocks in/for amounts directly proportional to their weight in the Dow Jones Industrial Average. Information with respect to the particular shares making-up the Dow Jones Industrial Average is provided to the FSI from Financial Instruments Pricing Source FIPS, either directly or by way of the CCIR—with the FSI, in turn, either being Dow Jones & Company or obtaining its information directly from Dow Jones & Company. As necessary, the balance between funds invested in money market accounts and funds invested in DJ Stocks will be modified so as to maintain the indicated one-third/two-third ratio, buying (or selling, if necessary) shares of DJ Stock in and/or for amounts directly proportional to their weight in the Dow Jones Industrial Average.

(3) Each one of the VC's purchased by the Person would be redeemable at any time (optionally: less a service charge if redeemed within a given time period after purchase) by the CCIR in an amount of U.S. dollars equal in purchasing power to the purchasing power (at the time of purchase) of the amount of U.S. dollars the individual had paid for that one VC. Or, stated differently, each VC would represent a constant purchasing power in the sense of being redeemable in an amount of U.S. dollars having increased (or decreased) since the time of purchase by an amount corresponding to the degree by which the CPI had increased (or decreased) since the time of purchase.

(4) At any later time, the Person may use his VC's for purchasing goods and/or services from one or more of the Purveyors; which Purveyors may then redeem the VC's by way of their own banks; which banks, in turn, will submit these VC's to CCIR's Financial Services Institution (FSI); which, in turn, will honor these VC's at their current dollar-equivalent purchasing power (as determined in accordance with the abovementioned Inflation Factor) by correspondingly debiting CCIR's account (i.e., the FSI Account) while communicating to the CCIR the code numbers of the redeemed VC's.

(ad) It is emphasized that the issuance by the CCIR of a Value Certificate to an individual may be accomplished simply by arranging for this individual to have a special account in his bank (or even in Financial Services Institution FSI) and then by appropriate (coded) communication to make an account entry in that special account; which special account would be adapted to accept credits and debits both in U.S. dollars and VC's—with each VC being individually identified by its unique code number.

(ae) In the preferred embodiment, in cases where an individual actually wishes to take physical delivery of his purchased Value Certificates (VC's), these VC's are printed by the Automatic Certificate Vending Machine, on specially prepared basic note blanks, at the time of purchase. Thus, the CCIR comprises a certificate printing means.

(af) Also, in the preferred embodiment, in purchasing VC's, an individual would have the option to select (at least part of) the unique identification code of each VC; which selection would be implemented by the individual by pressing appropriate keys on the Automatic Certificate Vending Machine.

(ag) Moreover, in the preferred embodiment, the individual would have the option of having each VC imprinted with his own (or anybody else's) name and/or identification/description, with the additional option of making the VC redeemable only by a person of that particular name and/or identification/description.

(ah) In the preferred embodiment, Central Certificate Issuer and Redeemer CCIR, in addition to including an Automatic Certificate Vending Machine ACVM, also includes computer means, modem means, communication means, keybord means, display means, printing means, etc., all interconnected and programmed such as to function in the manner herein specified.

More particularly, CCIR comprises a computer means: (i) connected with the ACVM, thereby permitting interaction between CCIR's computer means and individuals wishing to purchase and/or redeem VC's; (ii) connected in communication with Financial Services Institution FSI by way of a modem and a telephone line, thereby to provide for two-way communication between FSI's computer means and CCIR's computer means; (iii) by way of modems and telephone lines, connected in communication with a computer means at each of the plural Purveyors of Market Goods and/or Services; (iv) connected in two-way communication with Lottery Computer Means LCM; (v) having a first receiving means connected in communication with Market Goods Pricing Source MGPS (e.g., the Bureau of Labor Statistics of the U.S. Department of Labor), thereby to receive communications therefrom; (vi) having a second receiving means connected in communication with Financial Instruments Pricing Source FIPS (e.g., Dow Jones & Company), thereby to receive communications therefrom; (vii) having keybord, display and printing means operative to permit a person to monitor and/or verify the function of CCIR's computer means, to extract information with respect to issuance and/or redemption of VC's, to check status of CCIR's account(s) at the FSI, to modify programming of CCIR's computer means, etc.; and (viii) having transmitting means connected via modem and telephone line in communication with Publishing Means PM, thereby to transmit information thereto.

(ai) In effect, the plural Purveyors of Market Goods and/or Services are either holders of inventories of such Goods or they they are providers of such Services.

Market Goods can include anything that an individual (or a company) might wish to obtain in exchange for money. Thus, Market Goods may include such things as: general merchandise; commodities; financial instruments; art objects; raw materials; land; buildings; oil; gas; automotive vehicles; etc.

Likewise, Services can include any type of service that an individual (or a company) may wish to pay for, such as: telephone services; postal services; transportation services; funeral services; marketing services; labor services; newspapers and news services; farm services; design services; etc.

(aj) To a person having ordinary skill in the art pertinent hereto, it be clear that all the functions, elements, component parts, sub-systems, soft-ware, etc. associated with the system illustrated by FIG. 2 in general, and with Central Certificate Issuer and Redeemer CCIR in particular, are readily providable and combinable on basis of well known prior art.

More particularly, any person wishing to implement the system described in connection with FIG. 2 may simply approach a computer systems design and/or consulting service company and commission this company to provide such a system.

By way of example, such a person might wish to consult Ameritech's INDUSTRIAL Yellow Pages under headings such as: Automated Systems; Banking Equipment; Communications Consultants; Communications Equipment & Systems; Computer Consultants; Computer Dealers; Computer Services; Computer Software; Computer Systems Programming; Turnkey Computer Systems; Robotics; etc.

(ak) Central Certificate Issuer and Redeemer CCIR may in fact include plural subsidiary Certificate Issuers and Redeemers, all linked by computer and communication means to the CCIR. In fact, it is anticipated that—ultimately—a large number of banks and/or other financial institutions will be connected by tele-communication means with the CCIR and—in manner corollary to that of branch banks—function as Branch Certificate Issuers and Redeemers ("BCIR").

(al) The following definitions pertain hereto:

(1) the term "Basket of Goods and/or Services" refers to a pre-defined selection of goods and/or services; which predefined selection of goods and/or services is defined as having a given value which remains substantially constant over time. Thus, as inflation (or deflation) may reduce (or increase) the real value of a given amount of dollar funds over a span of time, the real value of the Basket of Goods and/or Services remain constant over the same span of time;

(2) the above-indicated Basket of Goods and/or Services is defined as representing a certain fixed number of Value Units; which means that the real value of each Value Unit remains constant over time;

(3) the term "Purchasing Power" of a given financial instrument (e.g., a dollar bill) refers to the amount of Value Units capable of being purchased by that financial instrument;

(4) the term "Money-Management Account" refers to an account with some financial services facility whereat money placed in that account is managed by the financial services facility in accordance with a predetermined investment algorithm, either as prespecified by the financial service facility or as specified by the holder of the account;

(5) the term "Bank Card" refers to what is otherwise frequently referred-to as a credit card and/or a debit card; which Bank Card is: (i) issued by some financial services facility (the card issuer) in the name of an individual, and (ii) is associated with an account in the name of that individual at the issuer of the Bank Card.

(am) In some circumstances it may be appropriate and/or desirable to define a Value Unit—instead of being a defined part of a basket having substantially constant real value—to be a defined part of a basket of goods and/or services whose real value might actually increase over time. For instance, a basket of the latter type might contain a pre-defined collection of common stock of various productive organizations. The so-called Dow Jones Industrial Average is in fact based on the market price of a pre-defined basket of the common stock of a certain collection of industrial corporations.

(an) In the arrangement of FIG. 2, it is re-emphasized that any and/or all of individuals I1, I2 . . . Ix may at various times in connection and/or communication with Financial Services Institution FSI as well as with each of Purveyors of Market Goods and/or Services PMGC1, PMGS2 . . . PMGSx. Also, it is emphasized that any and/or all of the Purveyors at various times be in connection and/or communication with FSI.

We claim:

1. A process comprising:

a first step whereby, at an initial point in time and at a first location, an individual obtains a value certificate in exchange for an initial amount of dollar funds; the value certificate entitling the owner thereof to receive, at a subsequent point in time and at a second location, in exchange for his value certificate, either a pre-defined amount of dollar funds or a pre-defined amount of goods and/or services from among a pre-defined selection of goods and/or services; the pre-defined amount of goods and/or services being defined as that amount of goods and/or services that could be purchased from the pre-defined selection of goods and/or services by the initial amount of dollar funds at the initial point in time; the pre-defined amount of dollar funds being equal to the amount of dollar funds required, at the subsequent point in time, to purchase the pre-defined amount of goods and/or services from among the pre-defined selection of goods and/or services; and a second step whereby, at the subsequent point in time and at the second location, the owner of the value certificate does in fact exchange the value certificate either for the predefined amount of dollar funds or for the pre-defined amount of goods and/or services from the pre-defined selection of goods and/or services.

2. The process of claim 1 wherein the first and the second steps are effectuated by a each one of a plurality of different individuals.

3. The process of claim 1 wherein the pre-defined selection of goods and/or services is defined by some or all of the goods and services underlying the Consumer Price Index as determined by the Bureau of Labor Statistics of the U.S. Department of Labor.

4. The process of claim 1 wherein the pre-defined amount of goods and/or services from the pre-defined selection of goods and/or services is chosen such as to represent a value that is substantially non-varying over time.

5. An arrangement for executing the process of claim 1, comprising:

first means operative to issue, to each of numerous persons, value certificates in exchange for dollar funds; the dollar funds thus received being deposited in a money-management account; each individual value certificate having a unique identification code and being denominated in a specific number of value units; each value unit representing a pre-defined amount of goods and/or services from a pre-defined basket of goods and/or services; and second means operative to supply goods and/or services to persons in exchange for value certificates; the amount of goods and/or services provided to a given person in exchange for a given value certificate denominated in a given number of value units being substantially independent of the time at which the given value certificate be exchanged for such goods and/or services; the given value certificate being redeemable by the first means, by debiting its money-management account, in an amount of dollar funds equal in purchasing power to that of the amount of dollar funds having been initially paid for this given value certificate.

6. The arrangement of claim 5 wherein the first means includes automatic teller-type machine operative, in response to certain key-board commands and insertion of a bank card, to supply a value certificate in exchange for debiting the particular bank account associated with the bank card.

7. The arrangement of claim 5 wherein: (i) the first means includes a first computer means; (ii) the money-management account is disposed at a financial services facility located remotely from the first computer means; (iii) the financial services facility has a second computer means arranged to handle the money-management account; and (iv) the first computer means is connected with the second computer means by way of two-way tele-communications means.

8. The arrangement of claim 5 wherein the first means includes means: (i) to periodically select at random one of the unique identification codes of one of the issued value certificates; and (ii) to accredit the value certificate having the chosen identification code with an additional amount of purchasing power.

9. An arrangement comprising:

first means operative to issue, to each of numerous persons, value certificates in exchange for dollar funds; each individual value certificate being denominated in a specific number of value units; each value unit representing a pre-defined amount of purchasing power; and second means operative to supply goods and/or services to persons in exchange for value certificates; the amount of goods and/or services provided to a given person in exchange for a given value certificate being proportional to the given value certificate's denomination in value units and therefore substantially independent of the time at which the given value certificate be exchanged for such goods and/or services; the given value certificate being redeemable by the first means in an amount of dollar funds equal in purchasing power to that of the amount of dollar funds having been initially paid for the given value certificate.

10. An arrangement comprising:

first means operative to issue, to each of numerous persons, value certificates in exchange for dollar funds; each individual value certificate being denominated in a specific number of value units; each value unit representing entitlement to a pre-defined amount of goods and/or services from a pre-defined basket of goods and/or services; and second means operative at any of plural different points in time to supply goods and/or services to persons in exchange for value certificates; the amount of goods and/or services obtainable by a given person at a given point in time in exchange for a given value certificate being proportional to the given value certificate's denomination in value units and therefore substantially independent of the time-location of the given point in time; the given value certificate being exchangeable by the first means in an amount of dollar funds equal in purchasing power to that of the amount of dollar funds having been initially paid for the given value certificate.

* * * * *